US007017499B2

(12) United States Patent
Schütz

(10) Patent No.: US 7,017,499 B2
(45) Date of Patent: Mar. 28, 2006

(54) REINFORCEMENT PLATE FOR THE BOTTOM OF A PALLET-LIKE SUPPORT BASE SUPPORTED ON CORNER AND CENTER FEET AND ON A BASE FRAME, ESPECIALLY FOR PALLET CONTAINERS

(75) Inventor: Udo Schütz, Selters/Westerwald (DE)

(73) Assignee: Protechna S.A., Fribourg (CH)

( * ) Notice: Subject to any disclaimer, the term of this patent is extended or adjusted under 35 U.S.C. 154(b) by 136 days.

(21) Appl. No.: 10/727,465

(22) Filed: Dec. 4, 2003

(65) Prior Publication Data

US 2004/0107879 A1 Jun. 10, 2004

(30) Foreign Application Priority Data

Dec. 4, 2002 (DE) ..... 202 18 766 U

(51) Int. Cl.
*B65D 19/00* (2006.01)

(52) U.S. Cl. ..... 108/51.11; 108/53.1

(58) Field of Classification Search ..... 108/51.11, 108/53.1, 53.3, 53.5; 206/386, 600, 599; 248/346.12

See application file for complete search history.

(56) References Cited

U.S. PATENT DOCUMENTS

| | | | | |
|---|---|---|---|---|
| 3,120,825 | A * | 2/1964 | Johnson | 108/53.3 |
| 3,526,195 | A * | 9/1970 | Maryonovich | 108/53.1 |
| 5,109,985 | A * | 5/1992 | Rose | 206/600 |
| 5,667,065 | A * | 9/1997 | Fahrion | 206/599 |
| RE35,875 | E * | 8/1998 | Shuert | 108/55.1 |
| 6,311,628 | B1 * | 11/2001 | Smith et al. | 108/55.1 |
| 6,382,108 | B1 * | 5/2002 | Stanek et al. | 108/55.1 |
| 6,644,220 | B1 * | 11/2003 | Gangloff et al. | 108/57.32 |
| 6,668,735 | B1 * | 12/2003 | Cassina | 108/57.25 |
| 6,899,225 | B1 * | 5/2005 | Shuert | 108/55.1 |

FOREIGN PATENT DOCUMENTS

EP 0673846 9/1995

* cited by examiner

*Primary Examiner*—Jose V. Chen
(74) *Attorney, Agent, or Firm*—Friedrich Kueffner

(57) ABSTRACT

A reinforcement plate for the bottom of a pallet-like support base supported on corner and center feet and on a base frame, especially for pallet containers, is provided with a stacking aid for stacking several reinforcement plates for shipping and storage purposes.

2 Claims, 3 Drawing Sheets

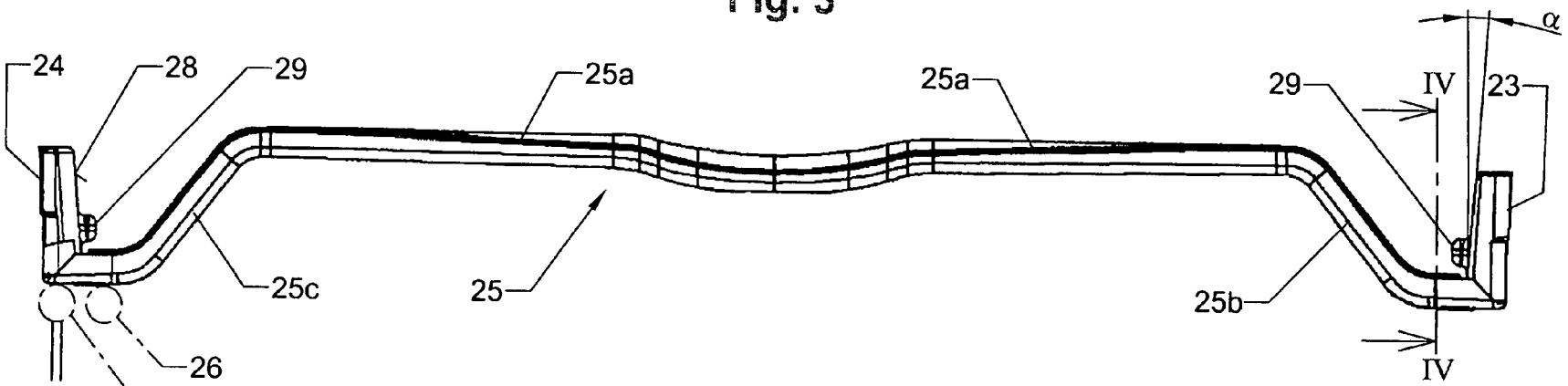
Fig. 3
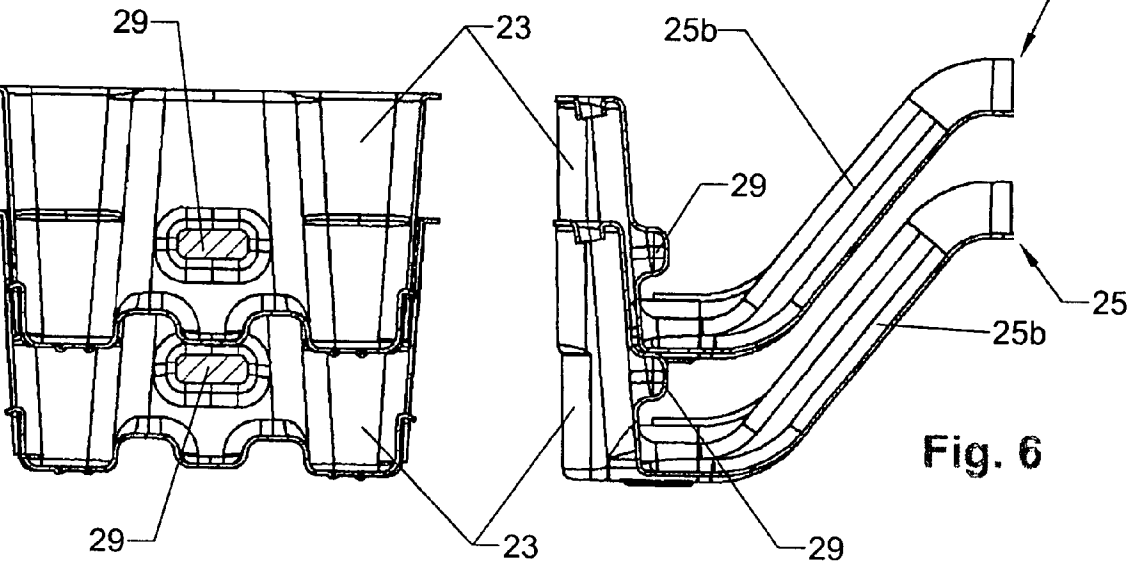
Fig. 6
Fig. 5
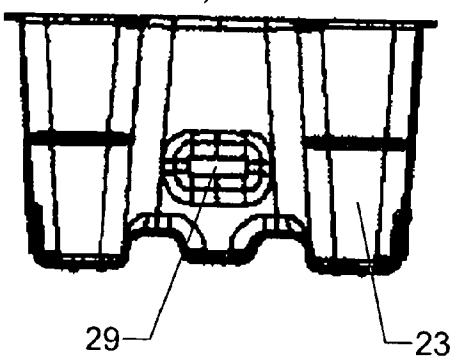
Fig. 4

REINFORCEMENT PLATE FOR THE BOTTOM OF A PALLET-LIKE SUPPORT BASE SUPPORTED ON CORNER AND CENTER FEET AND ON A BASE FRAME, ESPECIALLY FOR PALLET CONTAINERS

BACKGROUND OF THE INVENTION

The invention relates to a reinforcement plate for the bottom of a pallet-like support base supported on corner and center or middle feet and on a base frame. More particularly, the reinforcement plate is for a pallet container that has a plastic inner container, which has a filler connection and a drain connection and a drainage bottom with a central drainage channel, which slopes down from the rear wall of the container to the drain connection in the front wall of the container, such that the drainage bottom conforms to the bottom of the support base and rests on it. The container further has an outer jacket, which is designed as a sheet-metal jacket or metal cage and is mounted on the support base. The bridge-like reinforcement plate has two center feet integrally formed on both of its ends, such that the middle web of the reinforcement plate, which is mounted transversely to the drainage channel of the inner container under the bottom of the support base as a bearing member, passes over, via obliquely outwardly directed connecting webs, into the center feet for supporting the outer edge of the bottom of the support base. The reinforcement plate with the center feet is designed as a profile part.

Due to the geometric design, it is not possible to stack reinforcement plates of this type, which are described in EP 0 673 846 B1, to save space during shipping and storage before the final assembly of support bases, which are used especially for pallet containers.

SUMMARY OF THE INVENTION

The object of the present invention is to provide a reinforcement plate of this general type that has good stackability.

In accordance with the invention, this objective is achieved by a reinforcement plate having a middle web and two center feet integrally formed on both ends of the middle web such that the middle web, which is mountable transversely to the drainage channel of the inner container under the bottom of the support base as a bearing member, passes over via obliquely outwardly directed connecting webs into the center feet for supporting an outer edge of the bottom of the support base. The reinforcement plate with the center feet is a profile part. The reinforcement plate has a stacking aid that facilitates stacking of several reinforcement plates for shipping and storage purposes.

In another embodiment the center feet are inclined outwardly at an angle from vertical. At least one support knob is formed on an inside surface of the center feet as a support for a center foot of a stacked reinforcement plate. The support knobs project outwardly from the center feet.

The geometric design and the support knobs formed on the inside surface of the feet of the reinforcement plate of the invention, which is designed as a profile part, allow space-saving stacking of a number of reinforcement plates for shipping and storage and further allow reinforcement plates to be easily removed from a stack of reinforcement plates for final assembly of pallet-like support bases for pallet containers.

The various features of novelty, which characterize the invention, are pointed out with particularity in the claims annexed to and forming part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

FIG. 3 shows a side view of the reinforcement plate of the support base;

FIG. 4 shows a cross section of the reinforcement plate along line IV—IV of FIG. 3;

FIG. 5 shows a partial cross section of two stacked reinforcement plates; and FIG. 6 shows a partial longitudinal section of the stacked plates of FIG. 5.

DETAILED DESCRIPTION OF THE INVENTION

Figure 1:
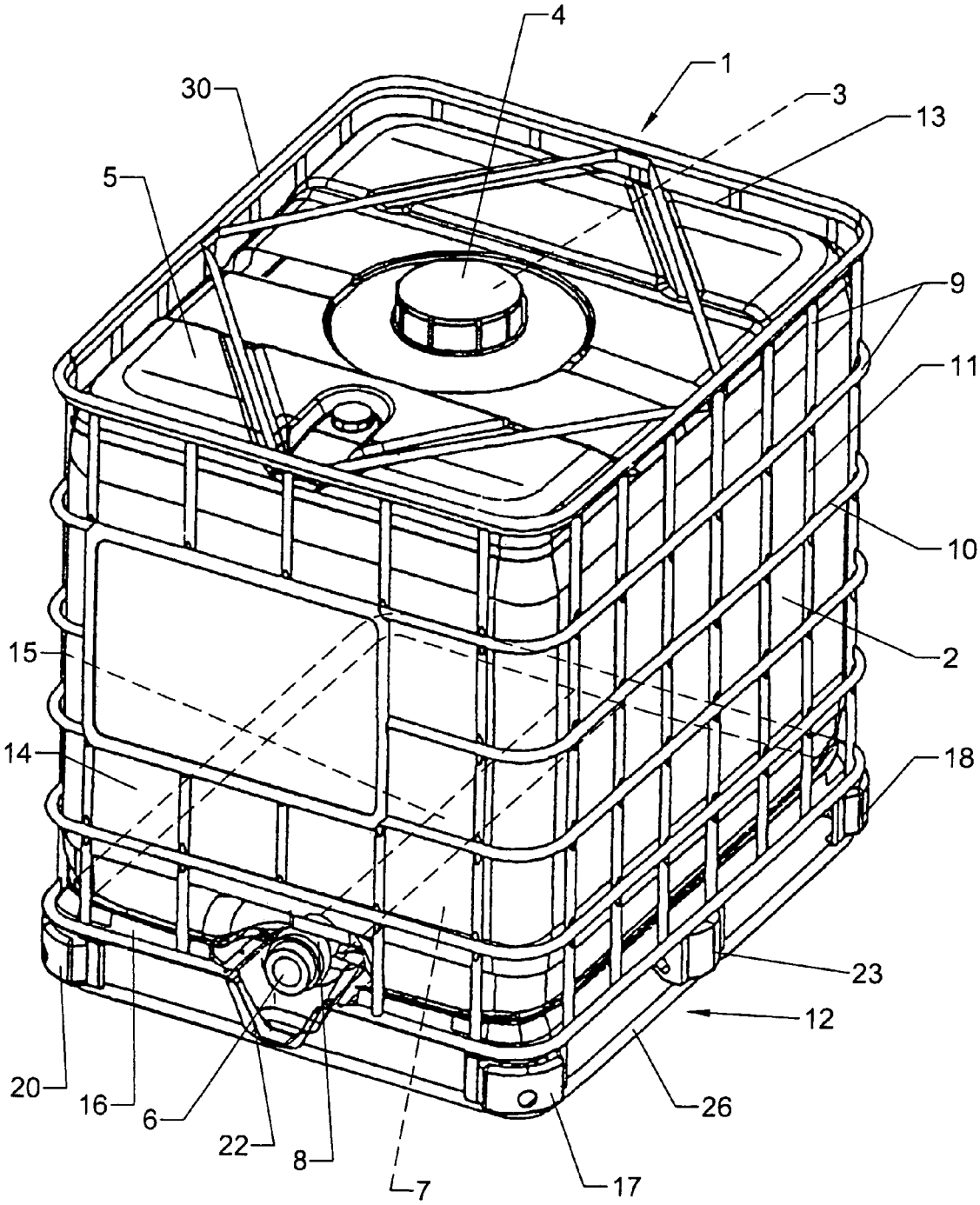
FIG. 1 shows a perspective view of a shipping and storage container for liquids with a pallet-like support base pursuant to the present invention.

The shipping and storage container 1 for liquids in FIG. 1, which can be used as a disposable or refillable container, has as its main components a replaceable plastic inner container 2 in a three-dimensional rectangular form. The inner container 2 has a top 5 with a filler connection 3 that can be closed with a cap 4, and a bottom 7 with a drain connection 6 for connecting a draining and rinsing cock 8. An outer jacket 9 consists of intersecting horizontal and vertical metal grating bars 10, 11. A pallet-like support base 12 is provided with length and width dimensions that conform to appropriated standards, such as European standards.

The bottom of the inner container 2 is a drainage bottom with a central drainage channel 15, which slopes down from the rear wall 13 of the container 2 to the drain connection 6 in the front wall 14 of the container 2. The drainage bottom 7 conforms to the bottom 16 of the support base 12 and rests on it.

Figure 2:
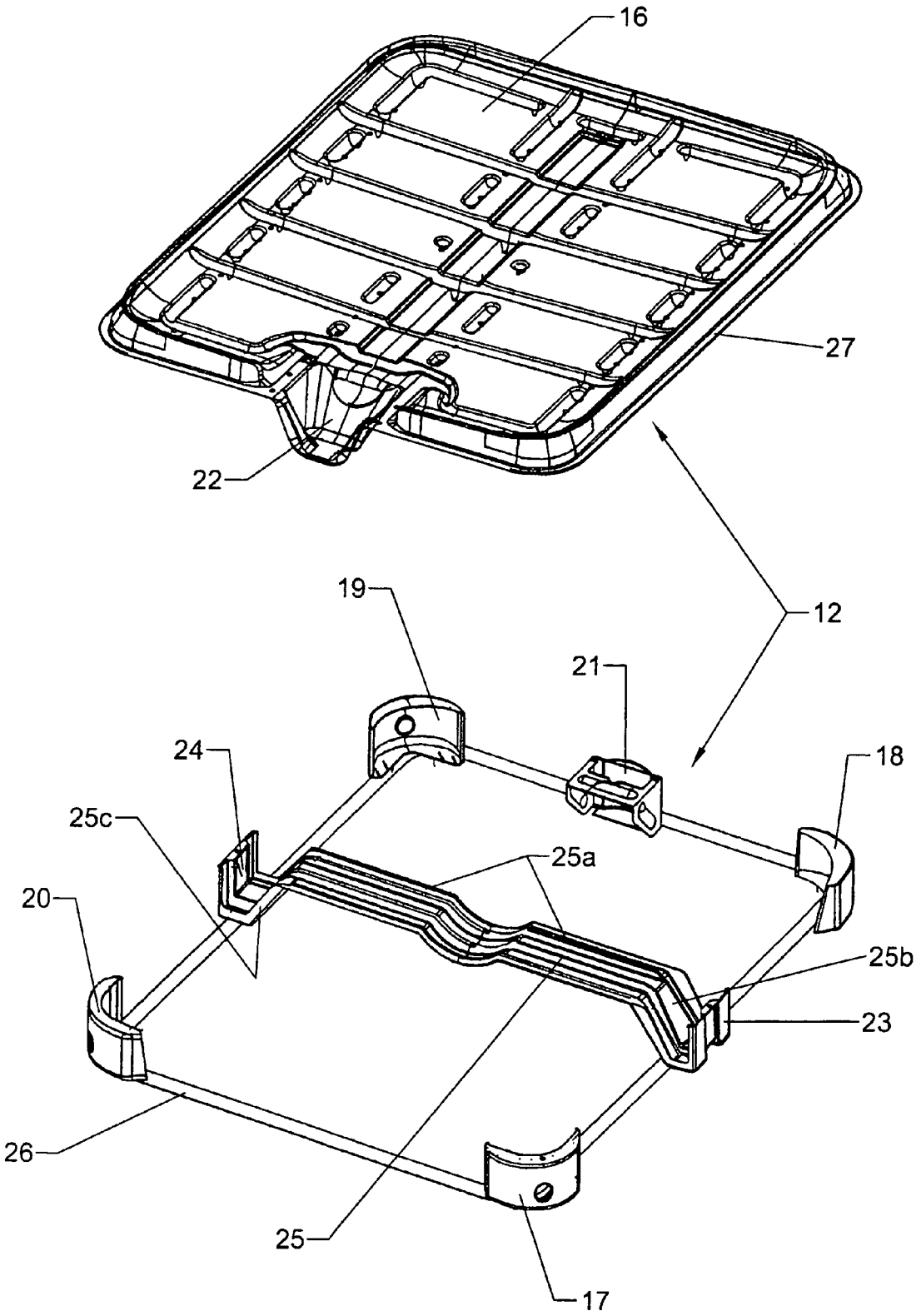
FIG. 2 shows an exploded view of the support base.

The bottom 16 of the support base 12 shown in FIG. 2 is pan-shaped and is equipped for handling by forklifts, rack trucks, and similar handling equipment. The bottom 16 rests on four corner feet 17–20, a rear center foot 21, a front center foot 22, which projects from the bottom 16 and is located below the draining and rinsing cock 8 of the shipping container 1, and two center feet 23, 24 on the sides. The center feet 23, 24 are formed by the outer ends of a bridge-like reinforcement plate 25 for the bottom 16.

The corner and center feet 17–24 of the support base 12 are welded onto a base frame 26.

A middle web 25*a* of the reinforcement plate 25, which is mounted transversely to the drainage channel 15 of the inner container 2 under the bottom 16 of the support base 12 as a bearing member, passes over into the center feet 23, 24 via obliquely outwardly directed connecting webs 25*b*, 25*c*. The center feet 23, 24 of the reinforcement plate 25 support the outer edge 27 of the bottom 16 of the support base 12 and are inclined slightly to the outside at an angle $\alpha$ from the vertical. A support knob 29 is formed on the inside surface 28 of the center feet 23, 24 as a support for a center foot 23, 24 of a stacked reinforcement plate 25 (FIGS. 5 and 6).

In the assembled state of the support base 12, the corner feet 17–20, the rear center foot 21, and the center feet 23, 24 at the sides of the reinforcement plate 25 project outwardly beyond the base frame 26 a sufficient distance such that, when the shipping and storage containers 1 are stacked, the corner feet 17–20 and the center feet 21–24 of the support base 12 of a container 1 rest on the upper frame 30 of the cage of the container 1 below it in the stack (FIG. 3).

The bottom 16 of the support frame 12, together with the outer jacket 9 of the shipping and storage container 1, which is designed in the form of a cage, is fastened by screws to the corner feet 17–20 and the center feet 21–24.

The reinforcement plate 25 with the center feet 23, 24 is designed as a profile part and is produced as a press-drawn part.

The invention is not limited by the embodiments described above which are presented as examples only but can be modified in various ways within the scope of the protection defined by the appended patent claims.

I claim:

1. A reinforcement plate for a bottom of a pallet-like support base supported on corner and center feet and on a base frame, for a pallet container with a plastic inner container, which has a filler connection and a drain connection and a drainage bottom with a central drainage channel that slopes down from a rear wall of the container to the drain connection in a front wall of the container, the drainage bottom conforming to the bottom of the support base and resting on it, and with an outer jacket, which is one of a sheet-metal jacket and a metal cage and is mounted on the support base, the reinforcement plate comprising: a middle web; and two center feet integrally formed on both ends of the middle web, the middle web, which is mountable transversely to the drainage channel of the inner container under the bottom of the support base as a bearing member, being configured to extend via obliquely outwardly directed connecting webs into the center feet for supporting an outer edge of the bottom of the support base, the reinforcement plate with the center feet being a profile part, the reinforcement plate having a stacking aid that facilitates stacking of several reinforcement plates for shipping and storage purposes, wherein the center feet are inclined outwardly at an angle from vertical, and further comprising at least one support knob formed on an inside surface of the center feet as a support for a center foot of a stacked reinforcement plate.

2. The reinforcement plate in accordance with claim 1, wherein the support knobs project outwardly from the center feet.

* * * * *